US011709030B2

(12) United States Patent
Baker et al.

(10) Patent No.: US 11,709,030 B2
(45) Date of Patent: Jul. 25, 2023

(54) STRUCTURED FIREARM BARREL

(71) Applicants: John L. Baker, Sheridan, IL (US); Jacob D. Baker, Sheridan, IL (US)

(72) Inventors: John L. Baker, Sheridan, IL (US); Jacob D. Baker, Sheridan, IL (US)

( * ) Notice: Subject to any disclaimer, the term of this patent is extended or adjusted under 35 U.S.C. 154(b) by 0 days.

(21) Appl. No.: 17/330,147

(22) Filed: May 25, 2021

(65) Prior Publication Data

US 2022/0049918 A1 Feb. 17, 2022

Related U.S. Application Data

(63) Continuation-in-part of application No. 16/866,010, filed on May 4, 2020, now Pat. No. 11,015,891, which is a continuation-in-part of application No. 15/752,043, filed as application No. PCT/US2016/046642 on Aug. 11, 2016, now Pat. No. 10,641,569.

(60) Provisional application No. 62/204,129, filed on Aug. 12, 2015.

(51) Int. Cl.
*F41A 21/22* (2006.01)
*F41A 21/48* (2006.01)
*F41A 13/12* (2006.01)

(52) U.S. Cl.
CPC ..... *F41A 21/22* (2013.01); *F41A 13/12* (2013.01); *F41A 21/482* (2013.01)

(58) Field of Classification Search
CPC ..... F41A 21/22; F41A 21/482; F41A 13/12
USPC ..... 42/76.01
See application file for complete search history.

(56) References Cited

U.S. PATENT DOCUMENTS 300,515 A * 6/1884 Schneider ..... F41A 21/18 42/78
812,140 A * 2/1906 Kent ..... F41A 21/28 89/14.3
1,341,363 A * 5/1920 Fiala ..... F41A 21/30 89/14.4
2,101,850 A * 12/1937 Green ..... F41A 21/36 89/14.3
2,340,821 A * 2/1944 Russell ..... F41A 21/40 42/76.01
2,377,317 A * 6/1945 Blume ..... B32B 17/1055 138/143
2,423,109 A * 7/1947 Monnet ..... F41A 21/38 89/14.4
2,428,232 A * 9/1947 Limon ..... F41A 21/42 89/14.3
3,742,640 A * 7/1973 Thomsen ..... F41A 21/02 42/76.01
4,829,877 A * 5/1989 Zerega ..... F41C 3/04 434/18
5,600,912 A * 2/1997 Smith ..... F41A 21/02 42/76.01
5,937,563 A * 8/1999 Schuetz ..... F41A 21/10 42/76.01

(Continued)

*Primary Examiner* — Samir Abdosh
(74) *Attorney, Agent, or Firm* — Shaddock Law Group, PC

(57) ABSTRACT

A barrel having a monolithic body, formed of an elongate structure extending from a breach end to a muzzle end; a projectile bore extending from a projectile chamber to the muzzle end; and a sleeve material positioned around at least a portion of the barrel to encompass at least a portion of the barrel, wherein the sleeve material includes filler particles embedded or dispersed within the sleeve material.

20 Claims, 14 Drawing Sheets

(56) References Cited

U.S. PATENT DOCUMENTS

| | | | | |
|---|---|---|---|---|
| 6,508,159 | B1 * | 1/2003 | Muirhead | F41A 21/24 89/14.05 |
| 9,186,712 | B1 * | 11/2015 | Wright | F41A 21/22 |
| 9,441,901 | B1 * | 9/2016 | Harrison | F41A 21/36 |
| 10,663,246 | B1 * | 5/2020 | Gelernter | F41A 21/30 |
| 11,079,194 | B1 * | 8/2021 | Sinnema | F41A 21/02 |
| 2013/0145669 | A1 * | 6/2013 | Zonshine | F41A 21/10 42/75.1 |
| 2017/0299291 | A1 * | 10/2017 | Spector | F41A 5/26 |
| 2019/0017176 | A1 * | 1/2019 | Deshpande | C23C 10/28 |
| 2020/0109907 | A1 * | 4/2020 | Klett | F41A 21/30 |
| 2021/0080214 | A1 * | 3/2021 | Gardner, Jr. | F41A 21/18 |
| 2022/0049918 | A1 * | 2/2022 | Baker | F41A 21/22 |

* cited by examiner

| Area of .4375 hole at a 30" long Structured Barrel With 2" adapter | | 1.00 | 1.50 | 2.00 | Diameter |
|---|---|---|---|---|---|
| | 2.00 | 3.14 | 4.71 | 6.28 | |
| | 4.00 | 6.28 | 9.42 | 12.57 | |
| 28.08 | 8.00 | 12.57 | 18.85 | 25.13 | |
| | 12.00 | 18.85 | 28.27 | 37.70 | |
| | 16.00 | 25.13 | 37.70 | 50.27 | |
| | Length | | | | |

FIG. 39

STRUCTURED FIREARM BARREL

CROSS-REFERENCE TO RELATED APPLICATIONS

This patent application is a continuation-in-part of U.S. patent application Ser. No. 16/866,010, filed May 4, 2020, which is a continuation-in-part of U.S. patent application Ser. No. 15/752,043, filed Feb. 12, 2018, which is a 371 of PCT/US16/46642, filed Aug. 11, 2016, which claims the benefit of U.S. patent application Ser. No. 62/204,129, filed Aug. 12, 2015, the disclosures of which are incorporated herein by reference in their entireties.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of barrels or projectile tubes. More specifically, the present disclosure relates to stiffening and/or cooling systems and methods for firearm barrels or projectile tubes.

2. Description of Related Art

It is generally known that firearm barrels or projectile tubes are typically formed of an elongate tube or tubular structure, usually constructed of metal, having a single projectile bore formed through the tube. In, for example, a handgun or rifle, the projectile bore extends from a projectile chamber, along a longitudinal axis of the barrel, to a terminating end. Rapidly expanding propellant gases from an explosive charge are released in at least a portion of a projectile chamber in order to propel a bullet or projectile through the projectile bore and out of the terminating end at a high velocity. Most typically, barrels or projectile tubes are components of firearms or artillery pieces.

Firearm barrels or projectile tubes are typically solid in nature without internal structures present, apart from the single, internal projectile bore. Solid forms add considerable weight as their diameters increase. Large diameters will add to the ability of the firearm barrel/tube to respond consistently to the explosive charge of the ignition and to the projectile traveling down the internal length. Large, heavy barrels (such as, for example, bull barrels) add weight to the system making them heavy and or ponderous to handle and move.

Solid barrels are also inefficient at dissipating heat. As the mass of the barrel increases, the surface area decreases for a given material. Therefore, the larger mass at some condition will be harder to cool since the heat input will be greater per ratio as compared to the reducing surface area.

Firearm barrels, particularly long rifle barrels may be machine bored from a cylindrical metallic barrel blank. The barrel blank may be rotated about its axis on a lathe, drilling, EDM, hammer forged, or drill like machine such that the interior is bore out with grooves to facilitate the rotation of a fired bullet. Many firearm barrels may be unable to maintain a consistent projectile shot after heavy usage or after altering projectile type manufacturers. Heavy use and alternate projectile types may impose significant and differing torsional and sinusoidal forces on the firearm barrel. Additionally, the barrel may become overheated. Furthermore, many firearm barrels contribute a substantial amount of weight to the overall weight of a manufactured firearm.

Some of the problems associated with typical firearm barrel reinforcement may be due to the lack of sufficient torsional and sinusoidal reinforcement, which may directly affect the stiffness of the firearm barrel and the accuracy of the projectile. The usage of a firearm may be further hindered by the unnecessary weight of the firearm barrels. After repeated use the firearm barrel may become overheated which may directly impact the accuracy of the projectile.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

To overcome these and other shortcomings of known firearm barrels or projectile tubes the presently disclosed systems and methods provide increased stiffening and/or cooling to firearm barrels or projectile tubes.

The barrel stiffening and/or cooling aspects of the present disclosure may optionally be accomplished by a radial pattern of elongate recesses that surrounds the bore or projectile chamber. The elongate recesses may be evenly distributed. Alternatively, the elongate recesses may be unequally distributed. The elongate recesses may be disposed in a single radial pattern or by multiple radial patterns and other configurations. Additionally, the elongate recesses may be disposed and in number such that they reduce the overall weight of the barrel stiffener apparatus and cooling system thereby allowing for the utilization of an enlarged barrel diameter.

The elongate recesses may increase the total surface area of the barrel stiffener apparatus and cooling system thereby facilitating cooling. An enlarged barrel diameter may increase the torsional stiffness and total surface area of the barrel stiffener apparatus and cooling system. The barrel stiffener apparatus and cooling system may have an outside surface texture. The surface texture may consist of raised ridges that traverse the barrel along a helical path or as individual rings. Alternatively, the surface texture may comprise other surface finishes and textures known by a person of ordinary skill within the art. The surface texture may increase the total surface area of the barrel stiffener apparatus and cooling system thereby facilitating cooling.

Further cooling may be accomplished by evacuation of the air within the elongate recesses by a Venturi effect. For example, the elongate recesses may be evacuated by the firing of a high velocity projectile through the projectile chamber or bore. When a high velocity projectile is fired, it may pull cool air into each of the elongate recesses as the projectile travels down the barrel bore.

In various exemplary, non-limiting embodiments, the presently disclosed systems, methods, and/or apparatuses provide a firearm barrel stiffener apparatus and cooling system that creates a stiffer barrel with enhanced cooling capabilities and a reduction in weight. In various exemplary, non-limiting embodiments, the barrel stiffness may be increased by enlarging the total diameter of the barrel and adding one or more hollow tubes, substantially along the longitudinal axis of the barrel.

In various exemplary, non-limiting embodiments, the hollow tubes assist in increasing the torsional and sinusoidal stiffness of the barrel as compared to a solid barrel of the same mass. In various exemplary, non-limiting embodiments, the barrel exhibits enhanced cooling capabilities due to the increased surface area of the barrel and the tubes.

In various exemplary, non-limiting embodiments, the barrel cooling capabilities are further enhanced by facilitating the ventilation of outside cool air in concert with evacuating the heated air within the barrel. The evacuation may be accomplished by a Venturi effect in which a fired projectile may pull outside cool air into the tubes as the projectile exits the barrel. Further cooling may be accomplished by exterior surface finishes and textures that may increase the surface area.

In various exemplary, non-limiting embodiments, the barrel stiffness is increased by the tubes acting as reinforcing tubes and resulting I-beam type structures reacting together to increase the torsional and sinusoidal stiffness of the barrel.

The barrel may have enhanced cooling capabilities due to the increased surface area of the barrel and reinforcing tubes.

In various exemplary, non-limiting embodiments, the presently disclosed barrel includes at least some of a body comprising an elongate structure extending from a breach end to a muzzle end; a projectile bore extending from a projectile chamber to the muzzle end; and one or more elongate recesses formed in the body, wherein each elongate recess is defined by an elongate hole extending from an open end formed in an area proximate the muzzle end.

In various exemplary, non-limiting embodiments, the presently disclosed barrel includes at least some of a body comprising an elongate structure extending from a breach end to a muzzle end; a projectile bore extending from a projectile chamber to the muzzle end; one or more elongate recesses formed in the body, wherein each elongate recess is defined by an elongate hole extending from an open end formed in an area proximate the muzzle end; and one or more apertures formed through the body, wherein each aperture provides fluid communication between an exterior of the barrel and at least one of the one or more elongate recesses.

In various exemplary, non-limiting embodiments, the presently disclosed barrel includes at least some of a body comprising an elongate structure extending from a breach end to a muzzle end; a projectile bore extending from a projectile chamber to the muzzle end; one or more elongate recesses formed in the body, wherein each elongate recess extends from the open end, along one or more side walls, to a bottom wall; and one or more apertures formed through the body, wherein each aperture provides fluid communication between an exterior of the barrel and at least one of the one or more elongate recesses.

In various exemplary embodiments, the elongate recesses may be produced using various techniques including drilling, electrical discharge machining (EDM), extrusion, molded shapes, 3D printing and various methods to produce structures along the bore path centerline.

Modeling can be utilized to determine the interaction of the shapes to the main bore centerline and its harmonic movement under firing and ignition events. The shapes could also be applied using a sleeve producing part of the shape with the other part integrated into the base barrel or as a complete sleeve with the patterns fully integrated into the sleeve.

Various methods could be used to apply the sleeve including but not limited to, threads, shrinking methods, wraps of various types, epoxy fillers, polyester fillers, two component fillers, heat activated fillers, chemically reactive fillers and other forms of common knowledge to a person of skill in the art.

Various simple or complex shapes may optionally be placed into the barrel blank or into a sleeve. Optional voids placed along the bore can be utilized to inhibit the ability of the barrel to harmonically vibrate when the platform is fired.

In various exemplary, non-limiting embodiments, the presently disclosed systems, methods, and/or apparatuses provide a barrel having at least some of a monolithic body comprising an elongate structure extending from a breach end to a muzzle end; a projectile bore extending from a projectile chamber to said muzzle end; one or more elongate recesses formed in said body, wherein each elongate recess is defined by an elongate hole extending from an open end formed proximate said muzzle end; a sleeve positioned around at least a portion of said barrel to encompass at least a portion of said barrel; and a radial ring, positioned between said barrel and said sleeve.

In various exemplary, non-limiting embodiments, the presently disclosed systems, methods, and/or apparatuses provide a barrel having at least some of a monolithic body comprising an elongate structure extending from a breach end to a muzzle end; a projectile bore extending from a projectile chamber to said muzzle end; one or more elongate recesses formed in said body, wherein each elongate recess is defined by an elongate hole extending from an open end formed proximate said muzzle end; and a sleeve positioned around at least a portion of said barrel to encompass at least a portion of said barrel.

In various exemplary, non-limiting embodiments, the presently disclosed systems, methods, and/or apparatuses provide a barrel having at least some of a monolithic body comprising an elongate structure extending from a breach end to a muzzle end; a projectile bore extending from a projectile chamber to said muzzle end; one or more elongate recesses formed in said body, wherein each elongate recess extends from an open end, along one or more side walls, to a bottom wall; and a sleeve positioned around at least a portion of said barrel to encompass at least a portion of said barrel.

In various exemplary, non-limiting embodiments, the presently disclosed systems, methods, and/or apparatuses provide a barrel having at least some of a monolithic body comprising an elongate structure extending from a breach end to a muzzle end; a projectile bore extending from a projectile chamber to the muzzle end; one or more elongate recesses formed in the body; and a sleeve positioned around at least a portion of the barrel to encompass at least a portion of the barrel and at least a portion of the one or more elongate recesses.

In various exemplary, non-limiting embodiments, the presently disclosed systems, methods, and/or apparatuses provide a barrel having at least some of a monolithic body comprising an elongate structure extending from a breach end to a muzzle end; a projectile bore extending from a projectile chamber to the muzzle end; and a sleeve material positioned around at least a portion of the barrel to encompass at least a portion of the barrel, wherein the sleeve material includes filler particles embedded or dispersed within the sleeve material.

In various exemplary embodiments, the sleeve material is applied to at least a portion of an exterior surface of the barrel.

In various exemplary embodiments, at least some of the filler particles extend from an outer surface of the sleeve material.

In various exemplary embodiments, at least some of the filler particles are removed from the sleeve material to form voids in an outer surface of the sleeve material.

In various exemplary, non-limiting embodiments, the presently disclosed systems, methods, and/or apparatuses provide a barrel having at least some of a monolithic body comprising an elongate structure extending from a breach end to a muzzle end; a projectile bore extending from a projectile chamber to the muzzle end; and a sleeve material applied around at least a portion of the barrel to encompass at least a portion of the barrel, wherein the sleeve material includes a plurality of filler particles embedded or dispersed within the sleeve material, and wherein at least some of the filler particles extend from an outer surface of the sleeve material.

Accordingly, the presently disclosed systems, methods, and/or apparatuses separately and optionally provide improved stiffness to firearm barrels and/or projectile tubes.

The presently disclosed systems, methods, and/or apparatuses separately and optionally provide improved cooling attributes to firearm barrels and/or projectile tubes.

The presently disclosed systems, methods, and/or apparatuses separately and optionally provide improved accuracy imparted to a bullet or projectile as it travels through a firearm barrel or projectile tube.

The presently disclosed systems, methods, and/or apparatuses separately and optionally create a stiffer barrel with enhanced cooling capabilities and a reduction in weight.

The presently disclosed systems, methods, and/or apparatuses separately and optionally provide a barrel having a larger diameter within similar weight to a smaller diameter barrel.

The presently disclosed systems, methods, and/or apparatuses separately and optionally provide a barrel having exterior surface finishes and textures.

The presently disclosed systems, methods, and/or apparatuses separately and optionally provide a barrel having improved cooling capabilities by facilitating the ventilation of outside cool air in concert with evacuating the heated air within the barrel.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein:

FIG. 39 illustrates a chart evidencing certain advantages of the barrel assembly, according to the presently disclosed systems, methods, and/or apparatuses.

DETAILED DESCRIPTION OF EXEMPLARY EMBODIMENTS OF THE PRESENT DISCLOSURE

Figure 1:
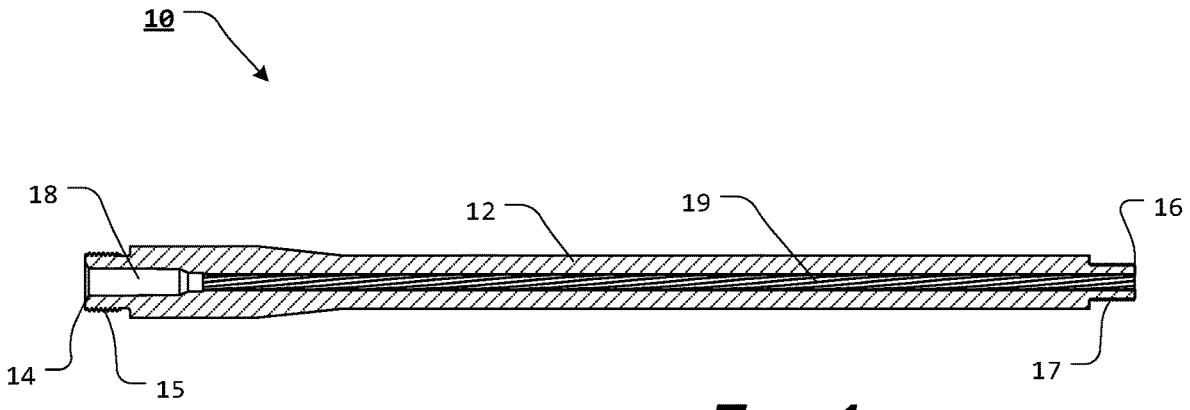
FIG. 1 PRIOR ART
FIG. 1 illustrates a side cross-sectional view of a known firearm barrel.

For simplicity and clarification, the design factors and operating principles of the barrel according to the presently disclosed systems, methods, and/or apparatuses are explained with reference to various exemplary embodiments of a barrel according to the presently disclosed systems, methods, and/or apparatuses. The basic explanation of the design factors and operating principles of the barrel is applicable for the understanding, design, and operation of the barrel of the presently disclosed systems, methods, and/or apparatuses. It should be appreciated that the barrel can be adapted to many applications where a barrel can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "firearm", "firearm barrel", "projectile tube", and "barrel" are used for basic explanation and understanding of the operation of the systems, methods, and apparatuses of the presently disclosed systems, methods, and/or apparatuses. Therefore, the terms "firearm", "firearm barrel", "projectile tube", and "barrel" are not to be construed as limiting the systems, methods, and apparatuses of the presently disclosed systems, methods, and/or apparatuses. Thus, for example, the term "barrel" is to be understood to broadly include any elongate tube or structure having at least one projectile bore formed through the tube.

For simplicity and clarification, the barrel of the presently disclosed systems, methods, and/or apparatuses will be described as being a barrel used in conjunction with a firearm, such as a rifle or carbine. However, it should be appreciated that these are merely exemplary embodiments of the barrel and are not to be construed as limiting the presently disclosed systems, methods, and/or apparatuses. Thus, the barrel of the presently disclosed systems, methods, and/or apparatuses may be utilized in conjunction with any object or device that uses a tube to restrain and guide an object or projectile.

As used herein, the word "exemplary" means "serving as an example, instance, or illustration". The embodiments described herein are not limiting, but rather are exemplary only. It should be understood that the described embodiments are not necessarily to be construed as preferred or advantageous over other embodiments.

Figure 2:
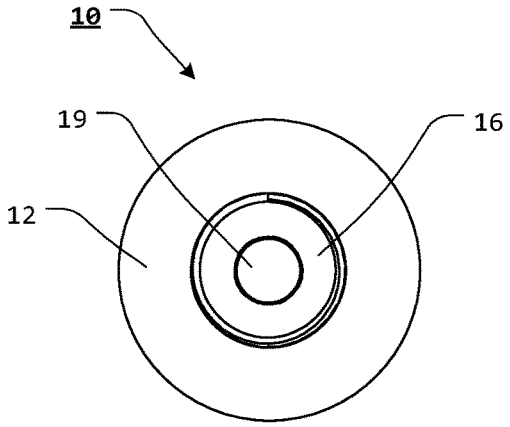
FIG. 2 PRIOR ART
FIG. 2 illustrates a front view of a known firearm barrel.
Figure 3:
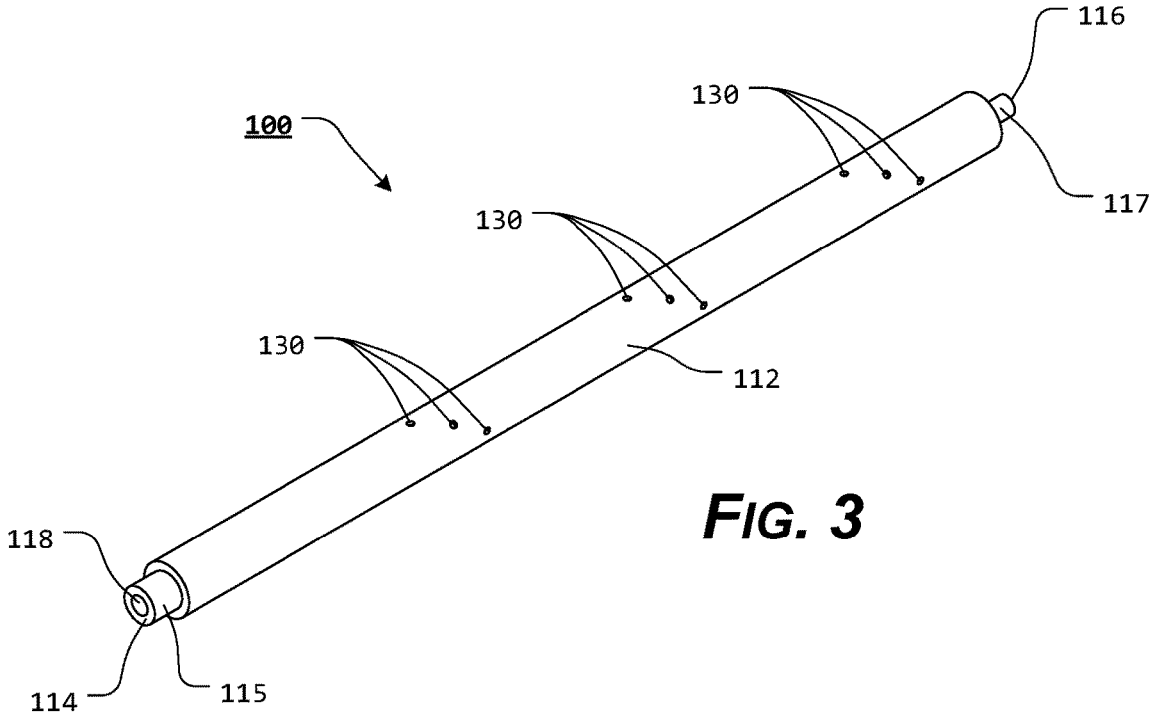
FIG. 3 illustrates an upper, rear, perspective view of an exemplary embodiment of a barrel, according to the presently disclosed systems, methods, and/or apparatuses.
Figure 4:
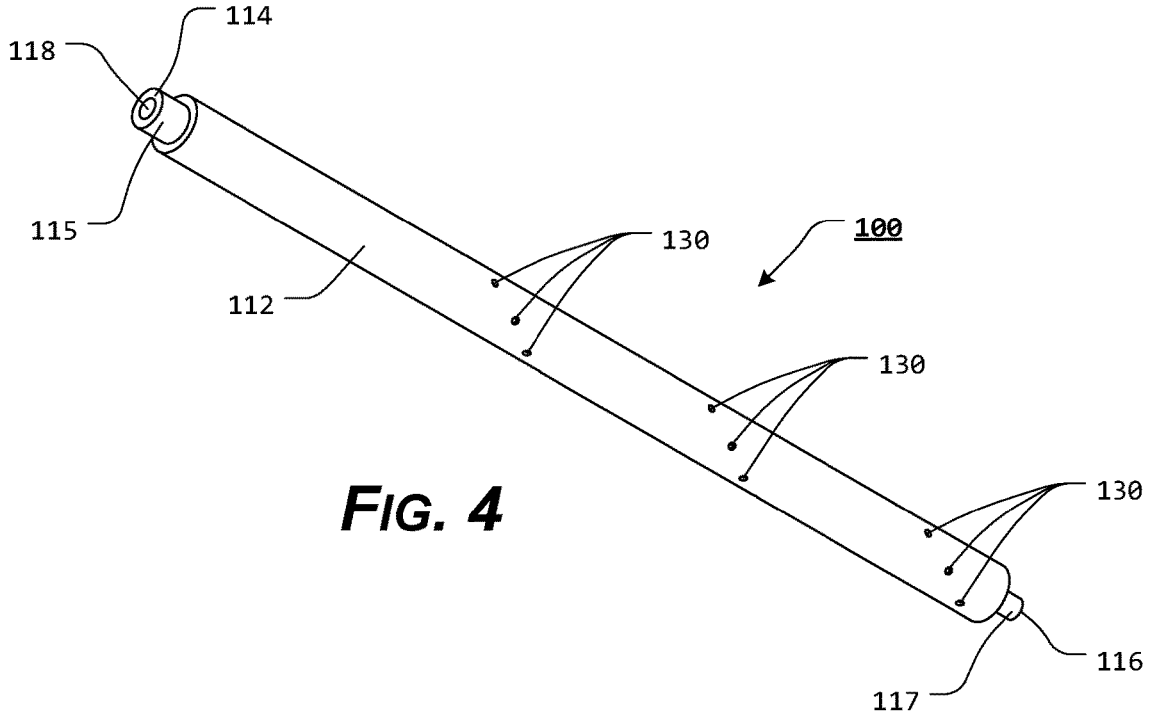
FIG. 4 illustrates a lower, rear, perspective view of an exemplary embodiment of a barrel, according to the presently disclosed systems, methods, and/or apparatuses.
Figure 5:
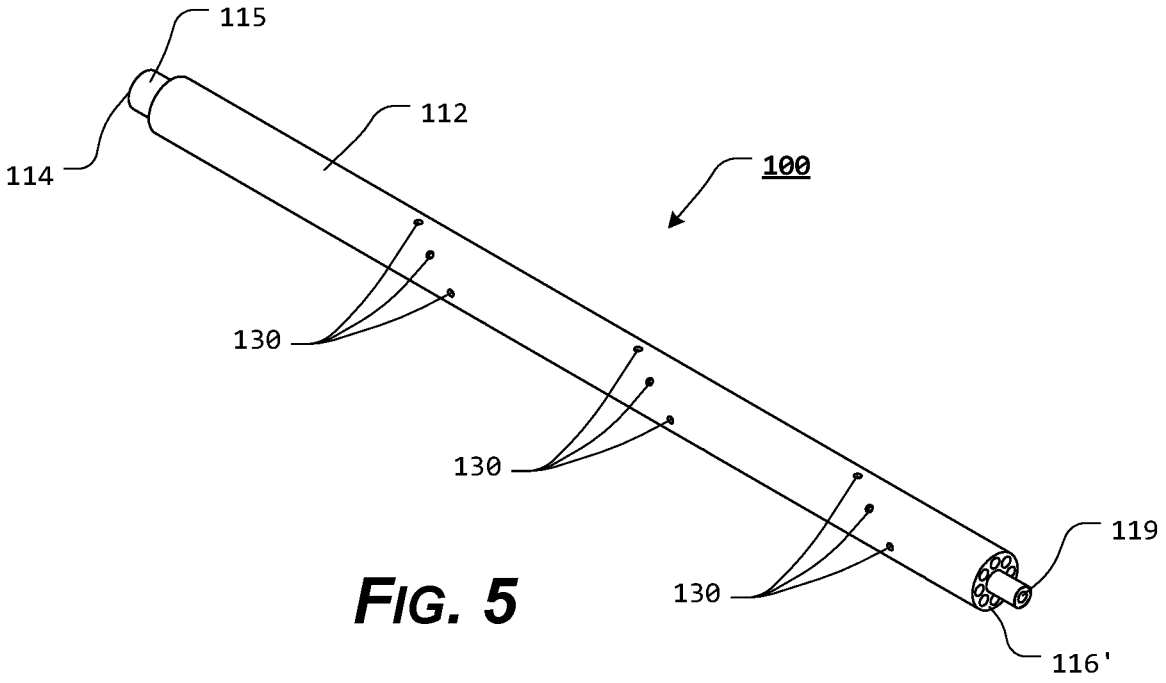
FIG. 5 illustrates an upper, front, perspective view of an exemplary embodiment of a barrel, according to the presently disclosed systems, methods, and/or apparatuses.
Figure 6:
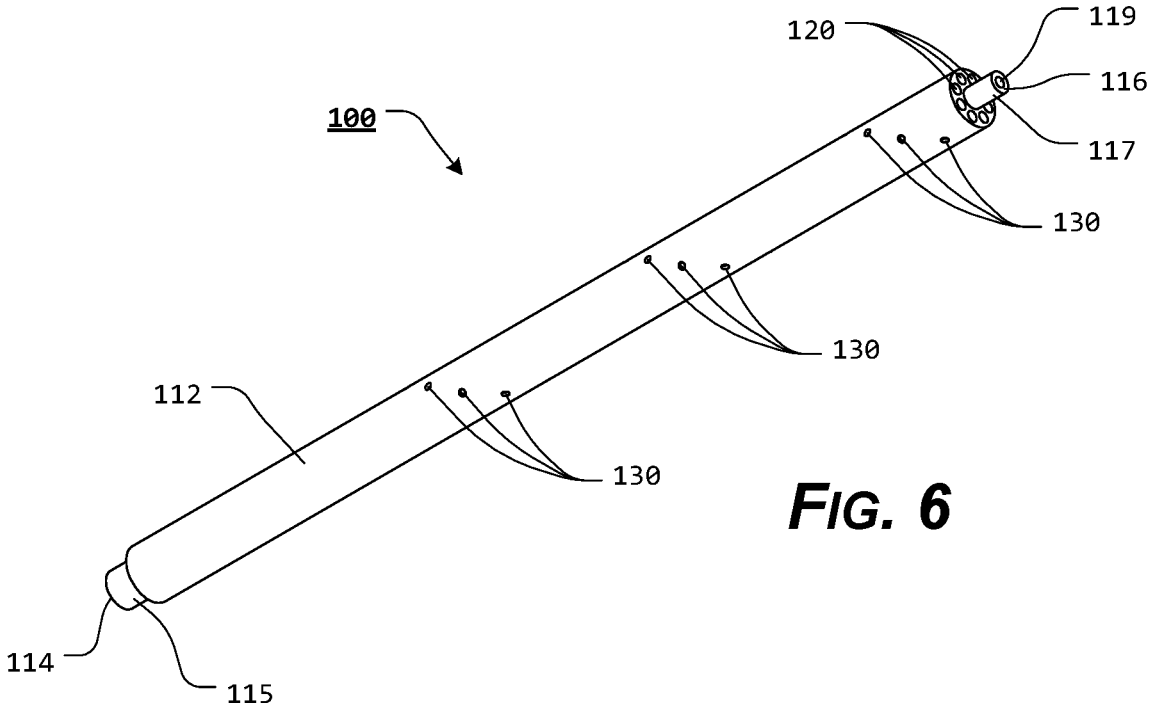
FIG. 6 illustrates a lower, front, perspective view of an exemplary embodiment of a barrel, according to the presently disclosed systems, methods, and/or apparatuses.
Figure 7:
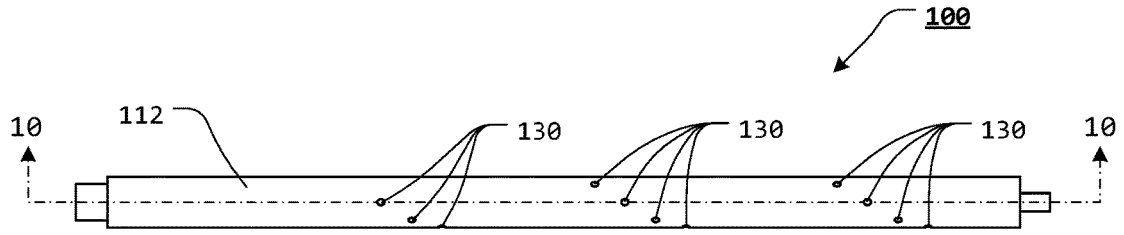
FIG. 7 illustrates a top view of an exemplary embodiment of a barrel, according to the presently disclosed systems, methods, and/or apparatuses.
Figure 8:
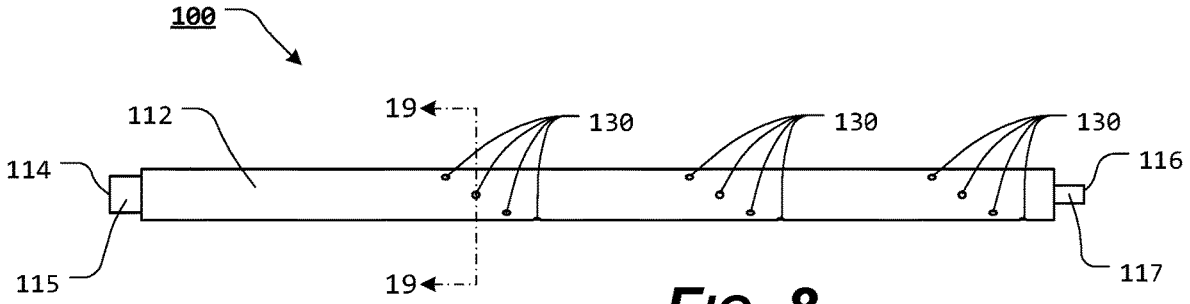
FIG. 8 illustrates a right side view of an exemplary embodiment of a barrel, according to the presently disclosed systems, methods, and/or apparatuses.
Figure 9:
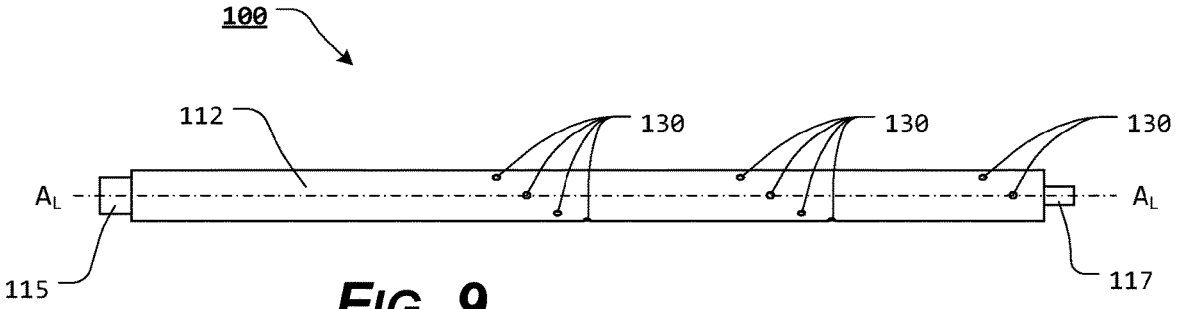
FIG. 9 illustrates a bottom view of an exemplary embodiment of a barrel, according to the presently disclosed systems, methods, and/or apparatuses.
Figure 10:
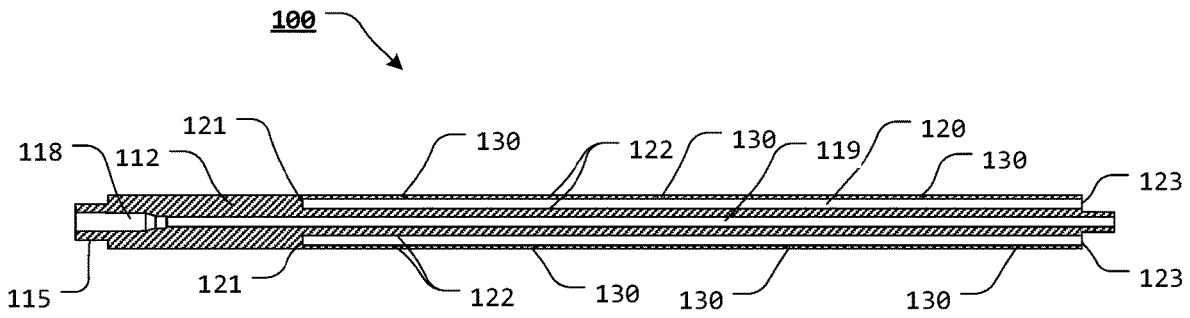
FIG. 10 illustrates a side, cross-sectional view taken along line 10-10 of the barrel of FIG. 7, illustrating an exemplary embodiment of a barrel, according to the presently disclosed systems, methods, and/or apparatuses.

Turning now to the appended drawing figures, FIGS. 1-2 illustrate an exemplary, known rifle barrel 10. As illustrated, the barrel 10 includes a body 12 comprising an elongate tube or structure extending generally from a breach end 14 to a muzzle end 16. A single projectile bore 19 extends from a projectile chamber 18, along a longitudinal axis of the barrel 10, to the muzzle end 16.

In various exemplary embodiments, at least a portion of the breach end 14 comprises external threads 15, which allow the barrel 10 to be threadedly attached or coupled to a receiver of a firearm.

In various exemplary embodiments, at least a portion of the muzzle end 16 comprises external threads 17, which allow various muzzle devices (such as, for example, muzzle brakes, flash hiders, flash suppressors, sound suppressors, etc.) to be threadedly attached or coupled to the muzzle end 16 of the barrel 10.

It should also be appreciated that a more detailed explanation of known firearm or other barrels is not provided herein because such additional background information will be known to one of ordinary skill in the art.

FIGS. 3-21 illustrate certain elements and/or aspects of an exemplary embodiment of a barrel 100, according to the presently disclosed systems, methods, and/or apparatuses. In illustrative, non-limiting embodiments of the presently disclosed systems, methods, and/or apparatuses, as illustrated most clearly in FIGS. 3-21, the barrel 100 comprises a body 112 comprising an elongate tube or structure extending generally from a breach end 114 to a muzzle end 116. The barrel 100 may be formed from a substantially solid cylindrical metallic barrel blank. The outer diameter of the body 112 is a design choice based upon the desired functionality and/or overall weight of the barrel 100.

A single projectile bore 119 extends from a projectile chamber 118, along a longitudinal axis, $A_L$, of the barrel 100, to the muzzle end 116. The inner and outer diameter of the projectile chamber 118 may be configured to any suitable size to account for various types and sizes of ammunition for varying purposes and safety concerns. The overall length of the barrel 100 is a design choice based upon the desired appearance and/or functionality of the barrel 100.

In various exemplary embodiments, at least a portion of the breach end 114 comprises external threads 115, which allow the barrel 100 to be threadedly attached or coupled to a receiver of a firearm.

In various exemplary embodiments, at least a portion of the muzzle end 116 may optionally comprise external threads 117, which allow various muzzle devices (such as, for example, muzzle brakes, flash hiders, flash suppressors, sound suppressors, etc.) to be threadedly attached or coupled to the muzzle end 116 of the barrel 100. Alternatively, the muzzle end 116 may optionally terminate without external threads 117 extending beyond the muzzle end 116.

One or more elongate recesses 120 are formed in the body 112 of the barrel 100. Each elongate recess 120 comprises an elongate hole formed so as to extend from the muzzle end 116 (or a shoulder 116' formed proximate the muzzle end 116). Each elongate recess 120 is defined by one or more side walls 122 and a bottom wall 121 and extends from the bottom wall 121, along the one or more side walls 122, to an open end 123.

While the elongate recesses 120 are illustrated and described as being substantially tubular or cylindrical, with a substantially circular cross-sectional profile, in various exemplary, nonlimiting embodiments, each of the elongate recesses 120 may have a substantially circular, rectangular, square, triangular, or other desired profile.

In various exemplary embodiments, the elongate recesses 120 are arranged in a radial pattern so as to surround the projectile bore 119. It should be appreciated that the size, shape, depth, number, and arrangement of elongate recesses 120 within the body 112 of the barrel 100 is a design choice. For example, as illustrated most clearly in FIGS. 17-19, eight elongate recesses 120 are arranged in a radial fashion, at spaced apart locations, around the projectile bore 119. The elongate recesses 120 are also arranged at a consistent distance from the projectile bore 119. In certain other exemplary embodiments, as illustrated most clearly in FIGS. 20-21, six elongate recesses 120 are arranged in a radial fashion, at spaced apart locations, around the projectile bore 119. The elongate recesses 120 are also arranged at a consistent distance from the projectile bore 119.

However, it should be appreciated that the number of elongate recesses 120 may be varied, the distance between adjacent elongate recesses 120 may be varied, and the distance between the elongate recesses 120 and the projectile bore 119 may also be varied. Furthermore, in various exemplary embodiments, various or alternating elongate recesses may be formed at varying distances from the projectile bore 119.

In various exemplary, nonlimiting embodiments, the elongate recesses 120 are evenly distributed. Alternatively, the elongate recesses 120 may be unequally distributed within the body 112 of the barrel 100. The elongate recesses 120 may be disposed in a single radial pattern or by multiple radial patterns and other configurations.

In certain exemplary, nonlimiting embodiments, the elongate recesses 120 may be disposed and in number, such that they reduce the overall weight of the barrel 100 thereby allowing for the utilization of an enlarged diameter of the barrel 100. Furthermore, the elongate recesses 120 may increase the total surface area of the barrel 100, thereby facilitating increased cooling. An enlarged diameter of the barrel 100 may increase the torsional stiffness and total surface area of the barrel 100.

In certain exemplary embodiments, the elongate recesses 120 are formed so as to have a longitudinal axis that is parallel or substantially parallel to the longitudinal axis of the projectile bore 119. Alternatively, the elongate recesses 120 may be formed so as to form a wave pattern or spiral through the body 112 of the barrel 100.

Thus, the barrel 100 optionally comprises multiple radially oriented elongate recesses 120 oriented around the axis of the projectile bore 119. The elongate recesses 120 may be applied on a single radial pattern or a multiple radial pattern. The elongate recesses 120 may be parallel to the longitudinal axis, $A_L$, of the projectile bore 119 spaced at substantially equal distance between adjacent elongate recesses 120 and the outer edge of the projectile bore 119.

In various exemplary, nonlimiting embodiments, the elongate recesses 120 may optionally provide an overall weight reduction to the barrel 100 by the removal of material from the body 112. In certain exemplary, nonlimiting embodiments the elongate recesses 120 may allow for the largest total diameter of the barrel 100 possible, which is made feasible due to the weight reduction directly attributed to the hollow elongate recesses 120.

In various exemplary, nonlimiting embodiments, the hollow elongate recesses 120 may optionally assist in increasing the torsional and sinusoidal stiffness of the barrel 100. This may be achieved because a larger total diameter barrel 100 is possible when compared to a substantially solid barrel or rod like structure of the same mass. The larger total diameter of the barrel 100 and the addition of the elongate recesses 120 may increase the strength and stiffness of the barrel 100.

In certain exemplary, nonlimiting embodiments, the elongate recesses 120 may create surfaces that will oppose each other as the elongate recesses 120 are stressed flexurally, tensionally, sinusoidally, and while in compression, thereby equalizing resultant forces from a fired projectile. In certain exemplary, nonlimiting embodiments, the elongate recesses 120 create a second stiffening structure, as the area between the elongate recesses 120 creates an "I-beam" type structure. "I-beam" type structures are known for their inherent stiffness due to their shape.

In certain exemplary, nonlimiting embodiments, the elongate recesses 120 may enhance the cooling capabilities of the barrel 100 due to an increased surface area of the barrel 100.

In certain exemplary, nonlimiting embodiments, cooling capabilities of the barrel 100 may be further enhanced by facilitating the ventilation of outside cool or ambient air in concert with evacuating the heated air within the elongate recesses 120 of the barrel 100. In certain exemplary embodiments, one or more apertures 130 are formed through the body 112 of the barrel 100 so as to provide fluid communication between the exterior of the barrel 100 and the cavity of the elongate recess 120.

In various exemplary embodiments, as illustrated most clearly in FIGS. 3-12, the apertures 130 may be provided in a substantially spiral arrangement along a portion of the barrel 100. Alternatively, as illustrated most clearly in FIG. 14, the apertures 130 may be provided in various spaced apart locations along a portion of the barrel 100. It should be appreciated that the inclusion, size, number, and position of the apertures 130 is optional and a design choice based upon the desired appearance and/or functionality of the barrel 100.

Figure 13:
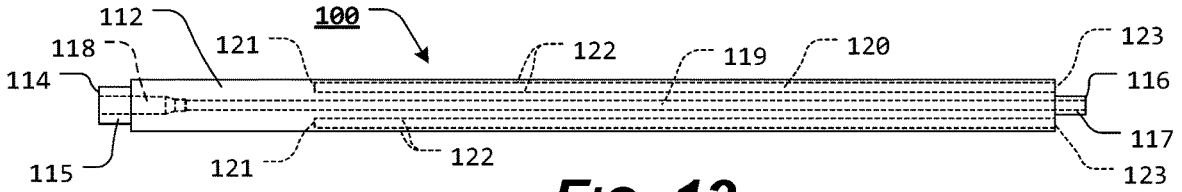
FIG. 13 illustrates a side view of an exemplary embodiment of a barrel, according to the presently disclosed systems, methods, and/or apparatuses.
Figure 14:
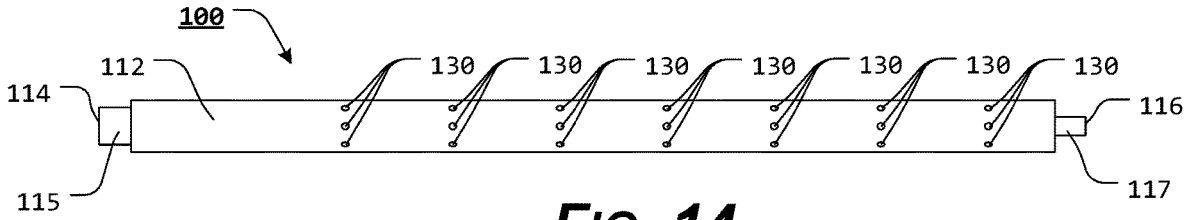
FIG. 14 illustrates a side view of an exemplary embodiment of a barrel, according to the presently disclosed systems, methods, and/or apparatuses.

As illustrated in FIG. 13, the apertures 130 may not be included, as they are optional.

If one or more apertures 130 are included, the evacuation of air within the one or more elongate recesses 120 may be accomplished by a Venturi effect in which a fired projectile may pull outside cool air into the elongate recesses 120, via the one or more apertures 130, as the projectile exits the barrel 100.

For example, at least a portion of the air within the elongate recesses 120 may be evacuated by the firing of a projectile through the projectile bore 119. When a projectile is fired, it may pull cool air into each of the elongate recesses 120, via the one or more apertures 130, as the projectile exits the muzzle end 116 of the barrel 100.

Figure 11:
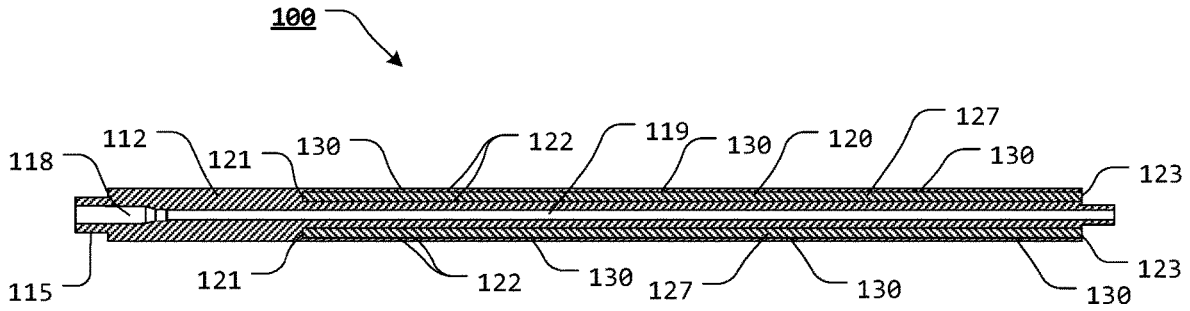
FIG. 11 illustrates a side, cross-sectional view taken along line 10-10 of the barrel of FIG. 7, illustrating an exemplary embodiment of a barrel, according to the presently disclosed systems, methods, and/or apparatuses.
Figure 12:
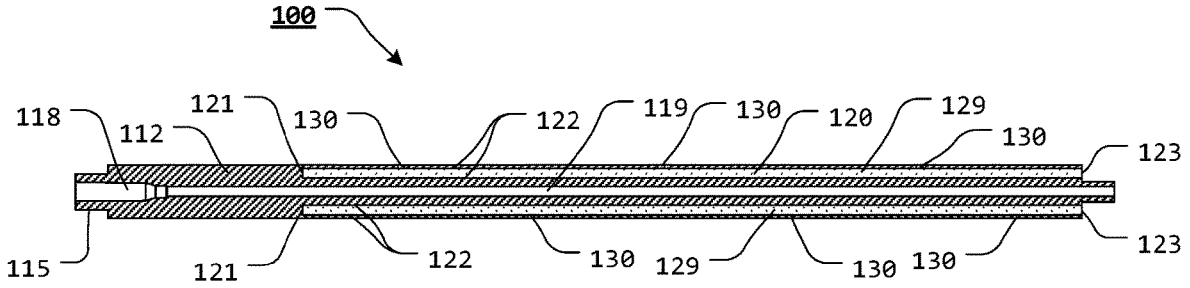
FIG. 12 illustrates a side, cross-sectional view taken along line 10-10 of the barrel of FIG. 7, illustrating an exemplary embodiment of a barrel, according to the presently disclosed systems, methods, and/or apparatuses.

In certain exemplary embodiments, as illustrated most clearly in FIGS. 11-12, at least a portion of the side walls 122 of the elongate recesses 120 includes surface preparations, coatings, or texturing. For example, surface preparations in the form of internal threads 127 can be formed to provide texturing to the side walls 122 of the elongate recesses 120. Alternatively, texturing 129, such as, for example, internal threads, stippling, surface preparation, coating, or texturing can be provided on at least a portion of the side walls 122 of the elongate recesses 120. Thus, additional cooling may be accomplished by adding internal textures to the elongate recesses 120 in the form of threads 127, texture 129, high heat transfer media, and/or by forced air cooling.

Figure 15:
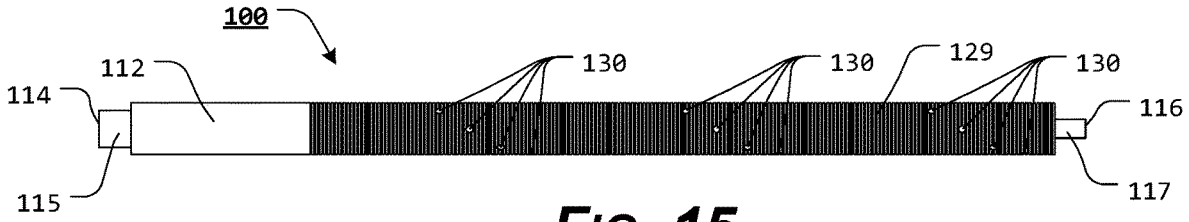
FIG. 15 illustrates a side view of an exemplary embodiment of a barrel, according to the presently disclosed systems, methods, and/or apparatuses.
Figure 16:
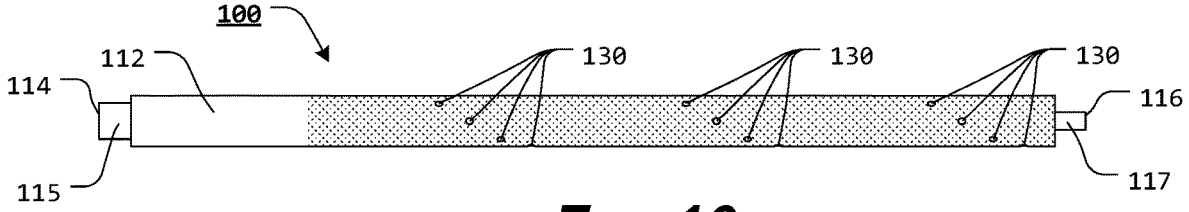
FIG. 16 illustrates a side view of an exemplary embodiment of a barrel, according to the presently disclosed systems, methods, and/or apparatuses.
Figure 17:
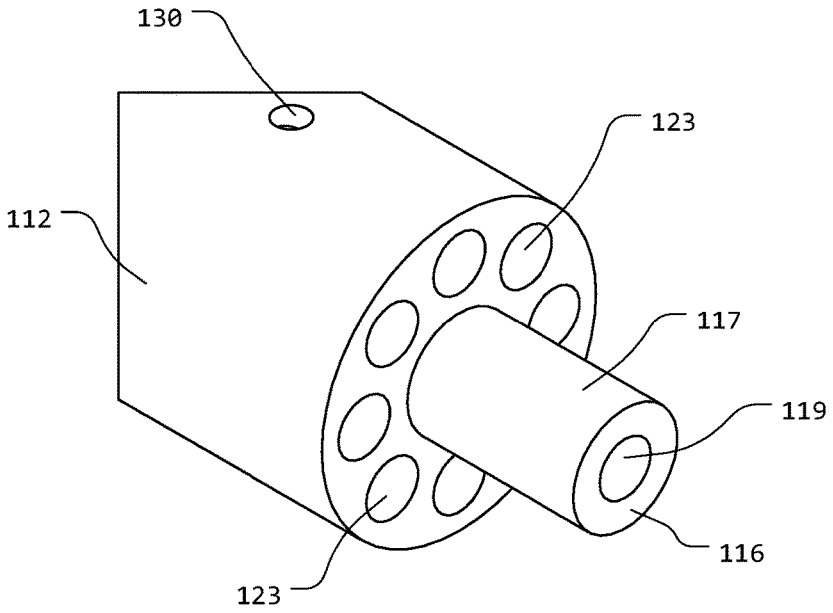
FIG. 17 illustrates an upper, front, perspective view of a front portion of an exemplary embodiment of a barrel, according to the presently disclosed systems, methods, and/or apparatuses.
Figure 18:
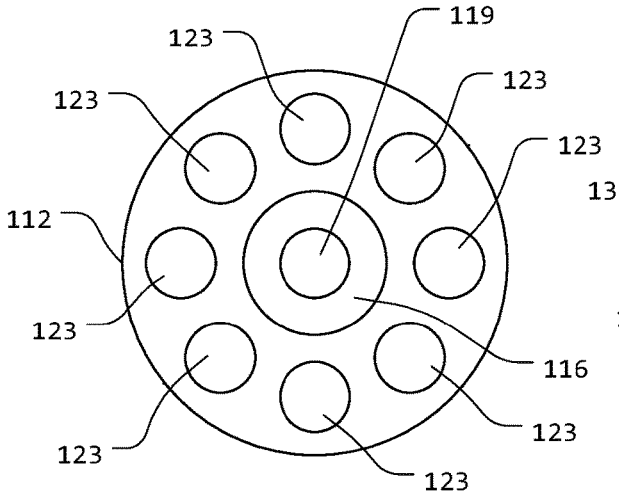
FIG. 18 illustrates a front view of an exemplary embodiment of a barrel, according to the presently disclosed systems, methods, and/or apparatuses.
Figure 19:
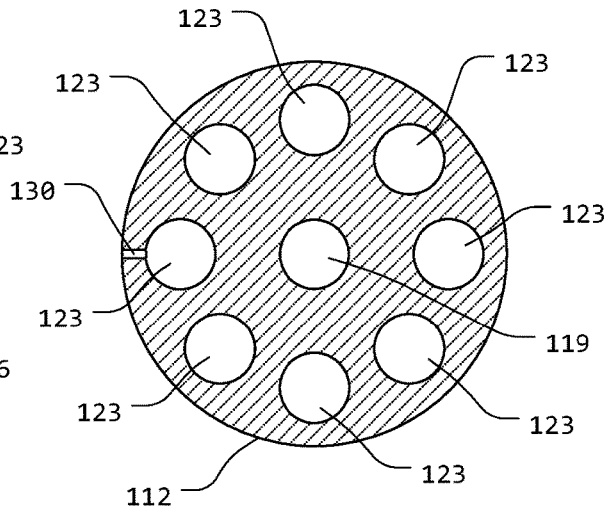
FIG. 19 illustrates a front, cross-sectional view taken along line 19-19 of the barrel of FIG. 8.
Figure 20:
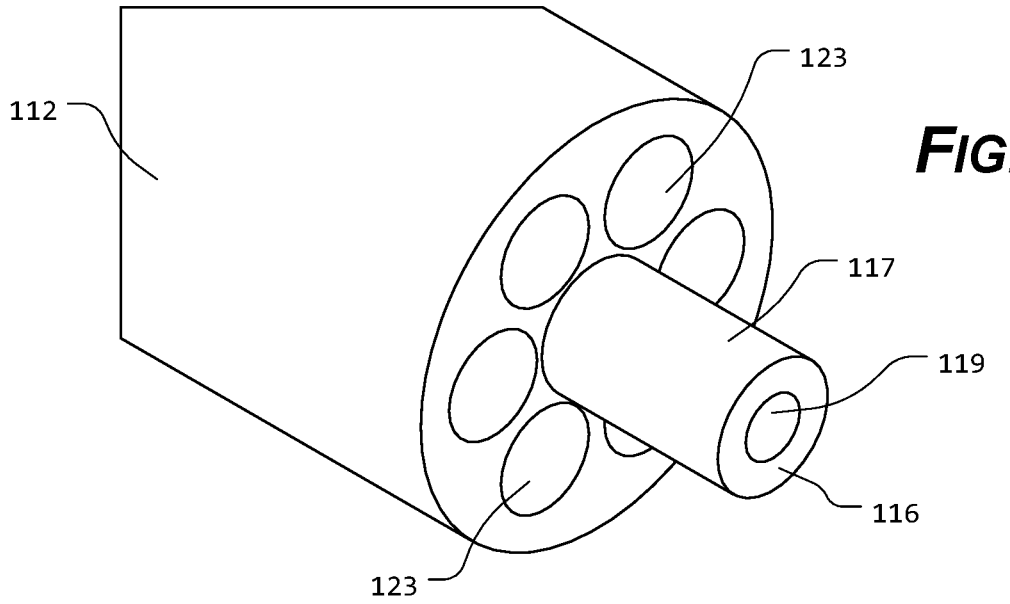
FIG. 20 illustrates an upper, front, perspective view of a front portion of an exemplary embodiment of a barrel, according to the presently disclosed systems, methods, and/or apparatuses.
Figure 21:
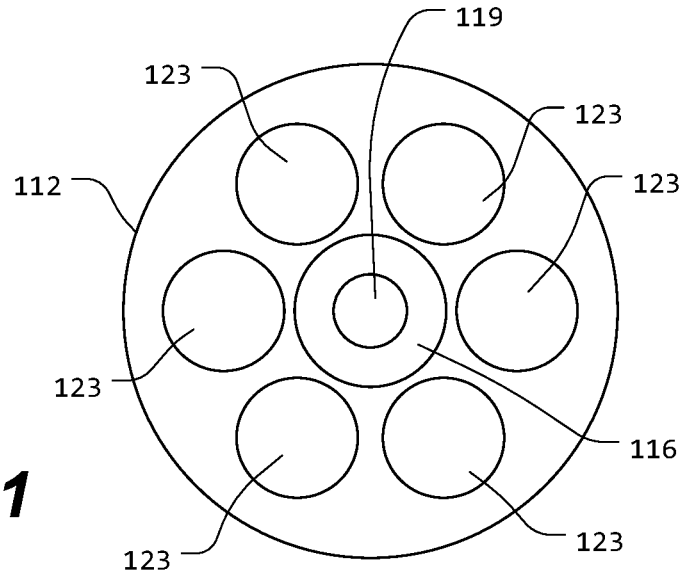
FIG. 21 illustrates a front view of an exemplary embodiment of a barrel, according to the presently disclosed systems, methods, and/or apparatuses.

As illustrated most clearly in FIGS. 15-16, various exterior surface finishes, coatings, and/or textures may be provided to the exterior surface 105 of the barrel 100 to increase the surface area of the barrel 100. By increasing the surface area of the barrel 100, further cooling of the barrel 100 can be accomplished.

In certain exemplary embodiments, as illustrated most clearly in FIG. 15, at least a portion of the exterior surface 105 of the barrel 100 may comprise surface texturing 140, comprising a plurality of raised ridges or recessed grooves that traverse the barrel 100 along, for example, a helical path or as individual rings. Alternatively, as illustrated most clearly in FIG. 16, the surface texture 150 may comprise other surface finishes and textures, such as, stippling, knurling, or other surface preparations, finishes, and/or texturing known by a person of ordinary skill within the art.

The surface texture 140 or 150 may increase the total surface area of the barrel 100, thereby facilitating increased cooling of the barrel 100.

Figure 22:
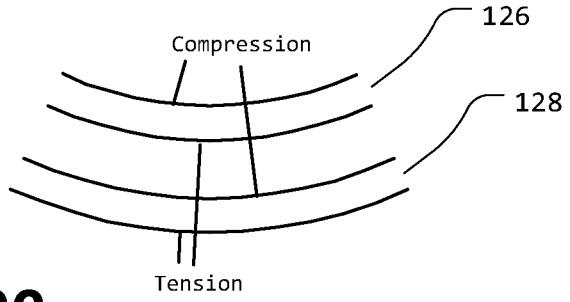
FIG. 22 illustrates a graphical representation of how exemplary elongate recesses may work against each other as resultant forces are distributed throughout the barrel, according to the presently disclosed systems, methods, and/or apparatuses.
Figure 23:
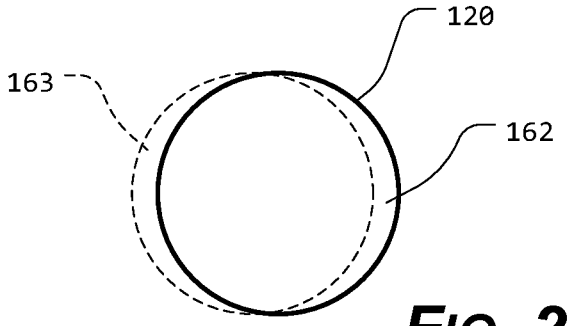
FIG. 23 illustrates a graphical representation of how exemplary elongate recesses may work against each other as resultant forces are distributed throughout the barrel, according to the presently disclosed systems, methods, and/or apparatuses.

The elongate recesses 120 may be disposed in alternating non-radial patterns. The elongate recesses 120 may extend longitudinally along the barrel 100 to a predetermined depth before or after the projectile chamber 118. In an exemplary embodiment, as illustrated generally to FIGS. 22-24, the elongate recesses 120 may work against each other as resultant forces are distributed throughout the barrel 100. The elongate recesses 120 may also work in isolation as resultant forces are distributed throughout the barrel 100. The elongate recesses 120 may work in concert with each other as resultant forces are distributed throughout the barrel 100.

In certain exemplary, nonlimiting embodiments, the material removed that creates the elongate recesses 120 creates a second stiffening structure in the form of one or more "I-beams". The one or more "I-beams" are distributed around the core of the barrel 100, which further creates areas or surfaces that resist bending in a second plane. For example, as a force is applied to an un-stressed original elongate recess 120 a resultant compression zone 162 and a tension zone 163 may occur. As one side of the elongate recess 120 goes into compression when a load is applied, the other side of the elongate recess 120 may go into tension.

The elongate recesses 120 may work against one another as illustrated by elongate recess 126 and elongate recess 120". When the edge of elongate recess 126 goes into tension, it will be impeded by the compression of elongate recess 120". The same scenario may apply to all elongate recesses 120 across the entirety of the barrel 100.

Figure 24:
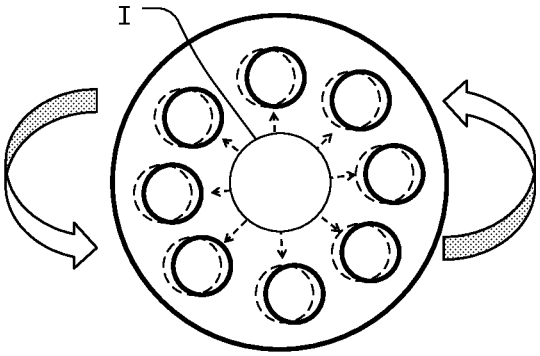
FIG. 24 illustrates a graphical representation of how exemplary elongate recesses may have an interaction such that the torsional stiffness of the barrel is increased, according to the presently disclosed systems, methods, and/or apparatuses.

As illustrated generally to FIG. 24, elongate recesses 120 may have an interaction "I" with one another such that the torsional stiffness of the barrel 100 is increased. Further, elongate recesses 120 may have an interaction "I" with one another such that the flexural stiffness of the barrel 100 is increased. Elongate recesses 120 may have an interaction "I" with one another such that the sinusoidal stiffness of the barrel 100 is increased. The elongate recesses 120 may resist a sinusoidal event because the elongate recesses 120 may hinder the propagation of a cohesive sinusoidal wave across the barrel 100.

The elongate recesses 120 may optionally be radially disposed around the projectile bore 119. The elongate recess 120 may be disposed in alternating non-radial patterns. The elongate recess 120 may extend longitudinally along the barrel 100 to a predetermined depth before or after the projectile loading chamber. In an exemplary embodiment, the elongate recesses 120 may work against each other as resultant forces are distributed throughout the barrel 100. The elongate recesses 120 may also work in isolation as resultant forces are distributed throughout the barrel 100. The elongate recesses 120 may work in concert with each other as resultant forces are distributed throughout the barrel 100. For example, as a force is applied to an un-stressed original elongate recess 120 a resultant compression zone 162 and a tension zone 163 may occur.

As one side of the elongate recess 120 goes into compression when a load is applied the other side of the elongate recess 120 may go into tension. The elongate recesses 120 may work against one another as illustrated by elongate recess 126 and elongate recess 128. When the edge of elongate recess 126 goes into tension it will be impeded by the compression of elongate recess 128.

The same scenario may apply to all elongate recesses 120 across the entirety of the barrel 100. Elongate recesses 120 may have an interaction with one another such that the torsional stiffness of the barrel 100 is increased. Further, elongate recesses 120 may have an interaction with one another such that the flexural stiffness of the barrel 100 is increased. Elongate recesses 120 may have an interaction with one another such that the sinusoidal stiffness of the barrel 100 is increased. The elongate recesses 120 may resist a sinusoidal event because the elongate recesses 120 may hinder the propagation of a cohesive sinusoidal wave across the barrel 100.

Figure 25:
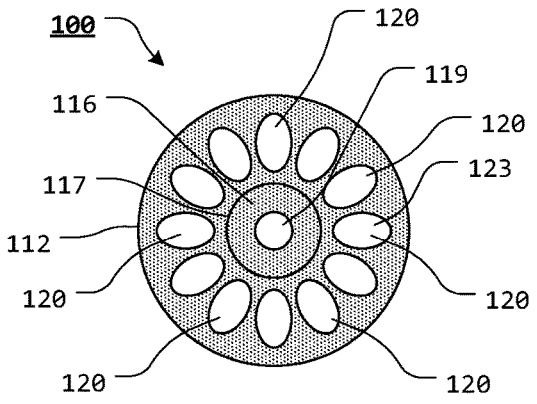
FIG. 25 illustrates a front view of an exemplary embodiment of a barrel, according to the presently disclosed systems, methods, and/or apparatuses.

As illustrated in FIG. 25, in certain exemplary embodiments, the elongate recesses 120 may optionally be arranged in a single radial pattern, wherein each elongate recess 120 has a substantially oval or ovular (egg-shaped) cross-sectional profile. In these exemplary embodiments, a relative center of each elongate recess 120 is spaced at the same or a substantially similar distance from the projectile bore 119. As illustrated, the elongate recesses 120 may optionally be arranged in a radial pattern so as to surround the projectile bore 119.

While FIG. 25, illustrates 12 equally shaped, equally sized, and equally spaced apart elongate recesses 120, it should be appreciated that the shape, size, number, and arrangement of the elongate recesses 120 within the body 112 of the barrel 100 is a design choice. For example, more or fewer elongate recesses 120 may be formed in the barrel 100 and the elongate recesses 120 may be formed at varying distances from other or adjacent elongate recesses 120 and may be formed at the same or varying distances from the projectile bore 119. Additionally or alternatively, adjacent elongate recesses 120 may be of the same size and shape or may have alternating sizes and/or shapes. Additionally, the depth of each elongate recess 120 may vary and is a design choice.

In certain exemplary embodiments, the elongate recesses 120 are formed so as to have a longitudinal axis that is parallel or substantially parallel to the longitudinal axis of the projectile bore 119. Alternatively, the elongate recesses 120 may be formed so as to form a wave pattern or a spiral as they extend through the body 112 of the barrel 100.

As described herein, in certain exemplary embodiments, one or more apertures 130 are formed through the body 112 of the barrel 100 so as to provide fluid communication between the exterior of the barrel 100 and the cavity of the elongate recess 120.

Figure 26:
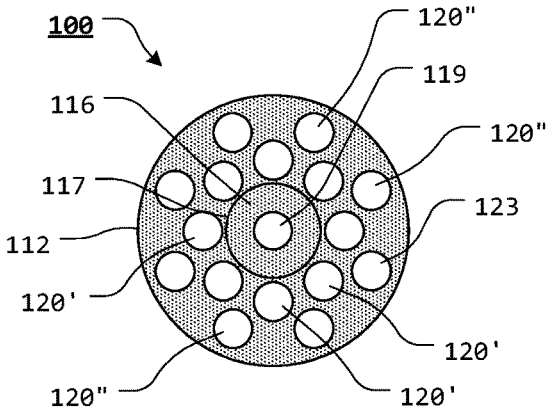
FIG. 26 illustrates a front view of an exemplary embodiment of a barrel, according to the presently disclosed systems, methods, and/or apparatuses.

As illustrated in FIG. 26, in certain exemplary embodiments, the elongate recesses 120 may optionally be arranged in multiple radial patterns, relative to the projectile bore 119. For example, as illustrated in FIG. 26, a first series of elongate recesses 120' are arranged so as to be spaced at the same or a substantially similar distance from the projectile bore 119. The first series of elongate recesses 120' are also arranged so as to be spaced apart from one another at the same or a substantially similar distance.

A second series of elongate recesses 120" are arranged so as to be spaced apart from the projectile bore 119 at a different distance than the spaced apart distance of the first series of elongate recesses 120'. Additionally, the second series of elongate recesses 120" are arranged so as to be spaced apart from one another at a different distance than the spaced apart distance of the first series of elongate recesses 120'.

While FIG. 26, illustrates 8 equally shaped, equally sized, and equally spaced apart elongate recesses 120' forming the first series of elongate recesses 120' and 8 equally shaped, equally sized, and equally spaced apart elongate recesses 120" forming the second series of elongate recesses 120", it should be appreciated that the shape, size, number, depth, and arrangement of the elongate recesses 120' and elongate recesses 120" within the body 112 of the barrel 100 is a design choice.

Figure 27:
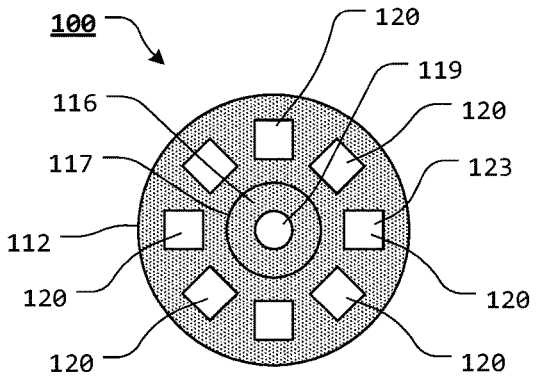
FIG. 27 illustrates a front view of an exemplary embodiment of a barrel, according to the presently disclosed systems, methods, and/or apparatuses.

As illustrated in FIG. 27, in certain exemplary embodiments, the elongate recesses 120 may optionally be arranged in a single radial pattern, wherein each elongate recess 120 has a substantially rectangular or square cross-sectional profile. In these exemplary embodiments, a relative center of each elongate recess 120 is spaced at the same or a substantially similar distance from the projectile bore 119. As illustrated, the elongate recesses 120 may optionally be arranged in a radial pattern so as to surround the projectile bore 119.

While FIG. 27, illustrates 8 equally shaped, equally sized, and equally spaced apart elongate recesses 120, it should be appreciated that the shape, size, number, and arrangement of the elongate recesses 120 within the body 112 of the barrel 100 is a design choice. For example, more or fewer elongate recesses 120 may be formed in the barrel 100 and the elongate recesses 120 may be formed at varying distances from other or adjacent elongate recesses 120 and may be formed at the same or varying distances from the projectile bore 119. Additionally or alternatively, adjacent elongate recesses 120 may be of the same size and shape or may have alternating sizes and/or shapes. Additionally, the depth of each elongate recess 120 may vary and is a design choice.

In certain exemplary embodiments, the elongate recesses 120 are formed so as to have a longitudinal axis that is parallel or substantially parallel to the longitudinal axis of the projectile bore 119. Alternatively, the elongate recesses 120 may be formed so as to form a wave pattern or a spiral as they extend through the body 112 of the barrel 100.

As described herein, in certain exemplary embodiments, one or more apertures 130 are formed through the body 112 of the barrel 100 so as to provide fluid communication between the exterior of the barrel 100 and the cavity of the elongate recess 120.

Figure 28:
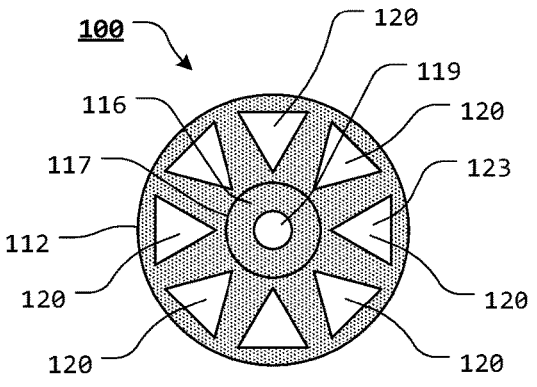
FIG. 28 illustrates a front view of an exemplary embodiment of a barrel, according to the presently disclosed systems, methods, and/or apparatuses.

As illustrated in FIG. 28, in certain exemplary embodiments, the elongate recesses 120 may optionally be arranged in a single radial pattern, wherein each elongate recess 120 has a substantially triangular cross-sectional profile. In these exemplary embodiments, a relative center of each elongate recess 120 is spaced at the same or a substantially similar distance from the projectile bore 119. As illustrated, the elongate recesses 120 may optionally be arranged in a radial pattern so as to surround the projectile bore 119.

While FIG. 28, illustrates 8 equally shaped, equally sized, and equally spaced apart elongate recesses 120, it should be appreciated that the shape, size, number, and arrangement of the elongate recesses 120 within the body 112 of the barrel 100 is a design choice. For example, more or fewer elongate recesses 120 may be formed in the barrel 100 and the elongate recesses 120 may be formed at varying distances from other or adjacent elongate recesses 120 and may be formed at the same or varying distances from the projectile bore 119. Additionally or alternatively, adjacent elongate recesses 120 may be of the same size and shape or may have alternating sizes and/or shapes. Additionally, the depth of each elongate recess 120 may vary and is a design choice.

In certain exemplary embodiments, the elongate recesses 120 are formed so as to have a longitudinal axis that is parallel or substantially parallel to the longitudinal axis of the projectile bore 119. Alternatively, the elongate recesses 120 may be formed so as to form a wave pattern or a spiral as they extend through the body 112 of the barrel 100.

As described herein, in certain exemplary embodiments, one or more apertures 130 are formed through the body 112 of the barrel 100 so as to provide fluid communication between the exterior of the barrel 100 and the cavity of the elongate recess 120.

Figure 29:
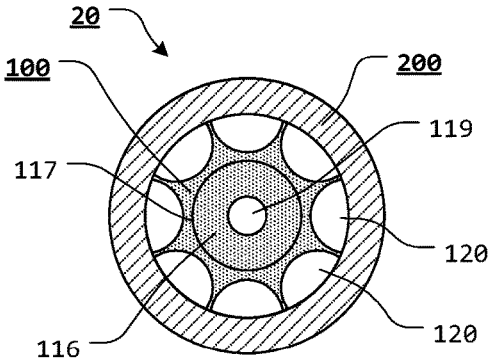
FIG. 29 illustrates a front view of an exemplary embodiment of a barrel, according to the presently disclosed systems, methods, and/or apparatuses.

As illustrated in FIG. 29, each of the elongate recesses 120 is formed of a recess, trough, or fluting formed along at least a portion of the exterior surface of the body of the elongate recesses 120. In various exemplary embodiments, each of the elongate recesses 120 extends, along a longitudinal axis, $A_L$, of the barrel 100, from an area proximate the breach end 114 to an area proximate the muzzle end 116. In various exemplary embodiments, the one or more elongate recesses 120 are arranged at spaced apart locations, substantially parallel to the longitudinal axis, $A_L$, of the barrel 100, along at least a portion of the barrel 100. Alternatively, the one or more elongate recesses 120 may optionally be formed in a substantially spiral arrangement along at least a portion of the barrel 100.

A wrap or sleeve 200 is then placed around at least a portion of the barrel 100 to encompass at least a portion of the barrel 100 and form a barrel assembly 20. The intersection between the elongate recesses 120 and the inner surface of the sleeve 200 form the complete elongate recesses 120.

The sleeve 200 adds to the diameter of the barrel 100 with minimum weight penalty. In various exemplary embodiments, one or more sleeves 200 may optionally be directly added to a barrel 100 or applied to sectioned shapes applied to the barrel 100. It should be understood using dissimilar materials will further add to the resistance of the barrel 100 to move into a harmonic whip or sinusoidal motion when a firing event takes place. These dissimilar materials can be added along the entire length or as sections to manipulate vibrations nodes. Applying a sleeve 200 to an extended shape or larger outer diameter of a barrel 100 will increase the effectiveness of the sleeve 200 while negating substantially issues of adhesion and mismatched coefficients of expansion as is common with current barrel sleeves. The sleeve 200 may optionally include carbon fiber, fiber glass, Kevlar or other meshes or clothes used in conjunction with fillers. Solid sleeves 200 may optionally be formed of various metallic materials, plastics or ceramics. It should be noted that the above descriptions are general and do not limit the application of reinforcement materials as applied to a barrel 100.

In certain exemplary embodiments, the barrel 100 may optionally be deeply fluted or channeled with one or more elongate recesses 120. Each elongate recess 120 may extend the entire length of the barrel 100 or may optionally extend along a portion of the barrel 100. A sleeve 200 is placed on or around at least a portion of an outer surface of the barrel 100 such that the inner surface of the sleeve 200 contacts at least a portion of the outer surface of the barrel 100.

In various exemplary embodiments, the barrel assembly 20 may be formed by press fitting the sleeve 200 onto the barrel 100 or the sleeve 200 may be spun welded on to the barrel 100. In certain exemplary embodiments, the barrel 100 may be cooled or frozen and the sleeve 200 may be placed on to the barrel 100. As the barrel 100 warms, the sleeve 200 is shrink fit to the barrel 100. In still other exemplary embodiments, the barrel 100 may be cooled and the sleeve 200 may be warmed or heated. Once the barrel 100 and the sleeve 200 reach appropriate temperatures, the sleeve 200 is placed on the barrel 100. As the barrel 100 warms and the sleeve 200 cools, a shrink fit is created between the barrel 100 and the sleeve 200.

The material used to form the sleeve 200 may be the same material, a substantially similar material, or may optionally be dissimilar to the material used to form the barrel 100. A dissimilar material may optionally be used to change characteristics of the barrel 100 and the barrel assembly 20 by further dampening sinusoidal whip and vibrations as the two dissimilar materials would resist each other's movements due to the materials being out of vibrational phase with each other. An example may optionally be the use of a 416 stainless steel barrel 100 and an aluminum sleeve 200. In this example, the aluminum sleeve 200 would have vibrational frequencies that are much higher than the barrel 100. Alternatively, an iron infused sleeve 200 may optionally be used to deaden the vibration or harmonics of the barrel 100. Other custom or advanced materials may optionally be used to impede vibration beyond a standard metal based material. By providing a sleeve 200 around the barrel 100, the barrel assembly 20 may have an increased surface area, which allows for increased cooling. By providing increased cooling, the barrel 100 may potentially be formed of a material or materials whose properties will not allow elevated temperature or have temperature limits such that the material or materials are not typically used to form a traditional barrel, as certain levels of heat would degrade or destroy the barrel.

The material used to form the sleeve 200 may optionally be used to enhance cooling by the material used to make the sleeve 200 or using the sleeve 200 as an intermediary for attaching other materials through bonding, migrating materials between the overlapping outer surface(s) of the barrel 100 and the inner surface(s) of the sleeve 200, attractive forces, and/or chemical bonds.

The barrel sleeve 200 may optionally be used to internally produce a sound reducing feature. The area produced by the long holes, recesses, or apertures formed by the one or more elongate recesses 120 may optionally be used to create baffles to produce a suppressor within the same area of the barrel 100 thereby reducing or negating the need for attachment of a sound suppressor to the muzzle end 116 of the barrel 100.

Current suppressors are typically thin walled devices that can quickly warp, are not easily disassembled, can add considerable length to a platform such that they have to be removed for transport and add an unwieldly length to the platform. They also add weight which is nearly inversely proportional to heat performance. A heavier unit might last longer but weight is added to the system.

By using the existing structure of this barrel design essentially all items are addressed.

The chart illustrated in FIG. 39 demonstrates the advantages of using the real estate/area of the barrel assembly 20. The first value of 28.08 cubic inches shows the inside area of a barrel 100 available for use to sound deaden a platform. The next column is a length of the device being compared to the length of a current suppressor. The row shows diameters that a suppressor would be built in. The numbers in the bordered area indicate a current suppressor's area with a length of x and a diameter. As outlined, the structured area provides a large starting area and is not exceeded until large, long external suppressors are employed. In this case expanding the deep structured hole by 0.063" will yield a 24% increase in internal volume of the barrel 100.

These optional embodiments would also improve the potential reliability of such devices by eliminating baffle strikes and/or incorrectly mounted suppressors and increase the total area that may optionally be used for sound reduction.

In certain exemplary embodiments, a sleeve 200 may optionally be positioned around at least a portion of the barrel 100 and shrunk fit into place and then a series of loading devices or threaded structures at or proximate the muzzle end 116 or the breach end 114 of the barrel 100 and/or in other areas such as the throat in order to provide a stress load to at least a portion of the barrel 100. A stress load may optionally be placed at or proximate each end of the barrel 100. However, a third position may optionally be added at the throat. At this point the barrel 100 may optionally be stressed in two opposing directions. Using a third position at the throat area of the cartridge sets the initial stress at a neutral position. This would be similar to joints between shapes used in ultra-sonic welding. A joint that is neutral in which vibration is set in motion at 180° to each other.

Figure 34:
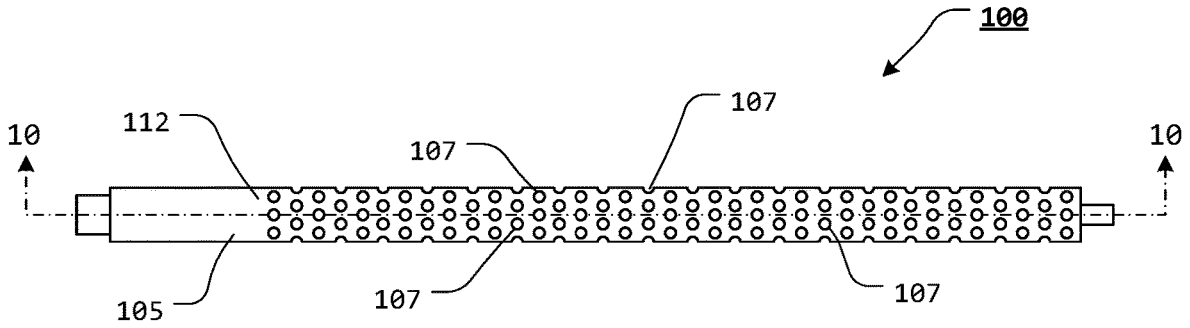
FIG. 34 illustrates a side view of an exemplary embodiment of a barrel, according to the presently disclosed systems, methods, and/or apparatuses.

Furthermore, apertures or recesses having more than one shape may optionally be formed in the barrel assembly 20, along the length of the barrel assembly 20. For example, as illustrated in FIG. 34, the one or more elongate recesses 120 may be replaced by a plurality of dimples 107 formed in a portion of the exterior surface 105 of the barrel 100, pending at or proximate the throat of the cartridge. A neutral solid area is then left in place for maximum pressure capability. Finally the tubes or secondary longitudinal features start. Creating such features work to prevent a harmonic from building and intensifying as the bullet travels down the projectile bore 119 of the barrel 100. The disparate features impede harmonic travel due to the fact the wave will encounter different shapes with different axis.

Structures can be made outside typical geometric structures. Structures may optionally be produced that are built within the base materials of the barrel 100 and/or the sleeve 200. An example would be aluminum infused with silica or even silicon. The material may optionally be sprayed onto a portion of the exterior surface 105 of the barrel 100 infused with a mix of potential secondary shapes and materials. These shapes would produce areas of heat transfer and could further impede vibration. It is well understood a cast portion of material does not vibrate the same way a forged portion of material does.

Figure 35:
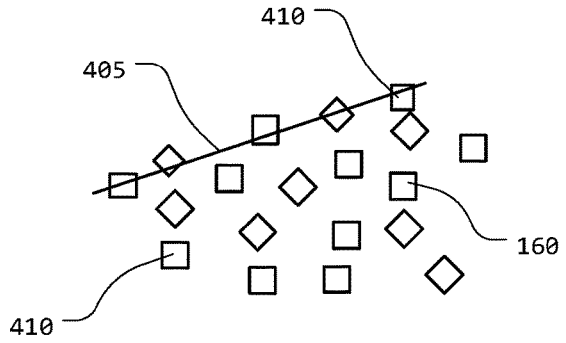
FIG. 35 illustrates a more detailed, partial view of an exemplary embodiment of a barrel covering or coating material, according to the presently disclosed systems, methods, and/or apparatuses.
Figure 36:
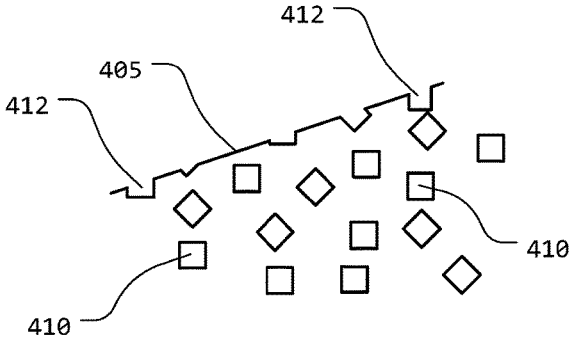
FIG. 36 illustrates a more detailed, partial view of an exemplary embodiment of a barrel covering or coating material, according to the presently disclosed systems, methods, and/or apparatuses.
Figure 37:
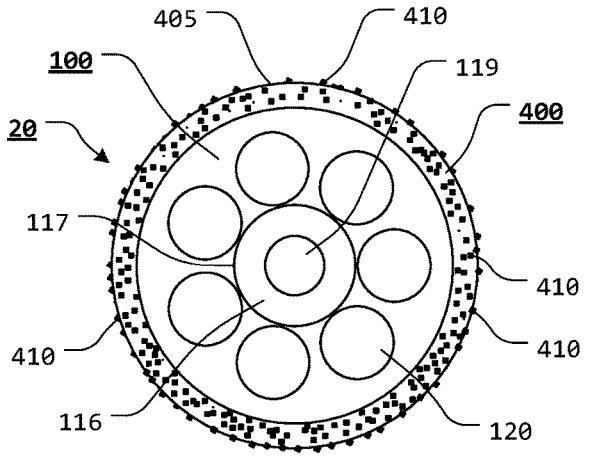
FIG. 37 illustrates a front view of an exemplary embodiment of a barrel at least partially coated with a material, according to the presently disclosed systems, methods, and/or apparatuses.
Figure 38:
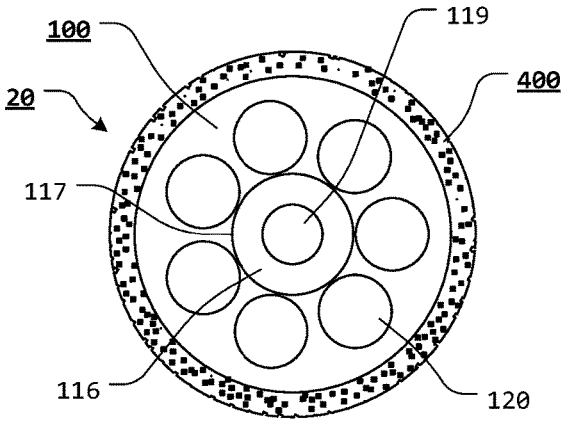
FIG. 38 illustrates a front view of an exemplary embodiment of a barrel at least partially coated with the material, according to the presently disclosed systems, methods, and/or apparatuses.

In certain exemplary, nonlimiting embodiments, as illustrated in FIG. 35-38, a sleeve material 400 is applied to the exterior surface 105 of the barrel 100. In various exemplary embodiments, the sleeve material 400 is applied by spraying the sleeve material 400. The sleeve material 400 may optionally include filler particles 410 embedded or dispersed within the sleeve material 400. As illustrated in FIGS. 35 and 37, the filler particles 410 may be dispersed within the sleeve material 400 such that at least some of the filler particles 410 extend from the outer surface 405 of the sleeve material 400. Alternatively, as illustrated in FIGS. 36 and 38, the filler particles 410 may be dispersed within the sleeve material 400 such that at least some of the filler particles 410 extend from the outer surface 405 of the sleeve material 400. In these exemplary embodiments, the filler particles 410 may comprise soluble or sacrificial filler particles 410 that may be melted, dissolved, or otherwise dissipated or removed to create voids 412 in at least the outer surface 405 of the sleeve material 400. Thus, the filler particles 410 add surface area or be sacrificed to create voids within at least a portion of the sleeve material 400.

Alternatively, the sprayed sleeve material 400 could have filler particles 410 applied that a post process could remove, leaving voids 412 within the metal or material being used. Immersing the prepared barrel 100 in a counter solution such as water, solvents, or acids would selectively remove the filler particles 410 leaving a porous material behind. A sand blast event may optionally be used to remove a carbon based material that is normally impervious to a solution.

A material or sleeve made with this type of structure would have a drastically reduced frequency response.

The resulting barrel 100 may have 400%, or more, of increased surface area. Creating filler particles 410 to make voids 412 or directly add surface area could add thousands of percent to the cooling surface. The base structure of the barrel 100 allows materials to be used that normally cannot be employed due to their lack of structural rigidity or ability to make a structure rigid. A very coarse example would be sand: sand by itself cannot be used in a structure and needs further binders. However the binders have to have enough density in the structure to overcome the sands individual particle traits.

Furthermore, sprayed materials may optionally be used to create a surface structure of significant surface area of high heat transfer materials. An example would be a surface similar to sandpaper, with millions if not billions of surface points. Examples of a sprayed material would be applied via atmospheric plasma spray or applied via wire spray gun or twin-wire arc.

Figure 30:
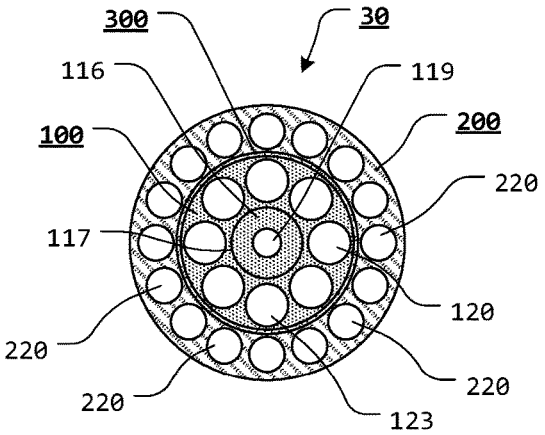
FIG. 30 illustrates a front view of an exemplary embodiment of a barrel, according to the presently disclosed systems, methods, and/or apparatuses.

FIG. 30 illustrates the addition of a radial ring 300, positioned between the barrel 100 and the sleeve 200 of a barrel assembly 30. Additional radial rings rapidly reinforce the rigidity and inhibit harmonic movement and vibrations of the barrel 100. The radial ring 300 can be optimized for stiffness versus area of the barrel 100 and/or barrel assembly 10.

Additionally, as illustrated in FIG. 30, the sleeve 200 includes a plurality of elongate recesses 220 formed therethrough. It should be appreciated that the elongate recesses 220 may have any of the features, described herein, with respect to the elongate recesses 120.

Figure 31:
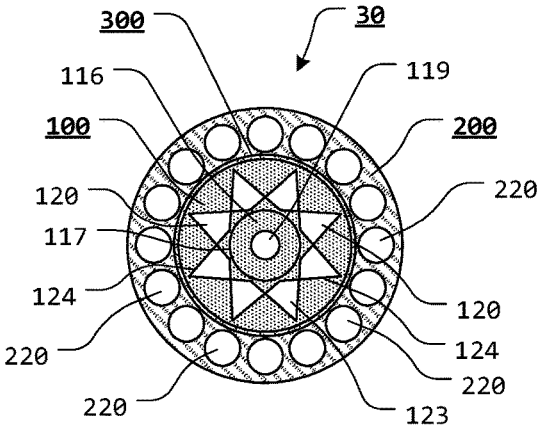
FIG. 31 illustrates a front view of an exemplary embodiment of a barrel, according to the presently disclosed systems, methods, and/or apparatuses.

FIG. 31 illustrates the barrel assembly 30, wherein the elongate recesses 120 are formed of a somewhat complex shape that cannot be easily machined with ordinary machine tools and employs other techniques to be formed in the barrel 100. In various exemplary embodiments, certain 3D printing techniques, powdered metal builds, and design criteria are utilized to create the elongate recesses 120 (or the elongate recesses 220).

Figure 32:
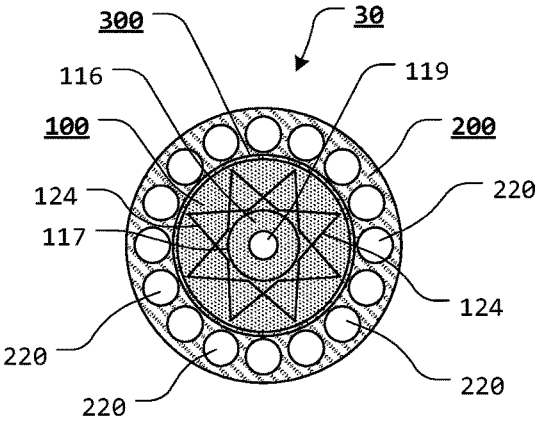
FIG. 32 illustrates a front view of an exemplary embodiment of a barrel, according to the presently disclosed systems, methods, and/or apparatuses.

In certain exemplary embodiments, as illustrated in FIGS. 31 and 32, one or more structural struts 124 surround or are formed through portions of the barrel 100 at various angles that not only reinforce the reduction of harmonic movement but maximize air flow for cooling properties per given weight of a structure.

The struts 124 are shown as an example and may optionally be placed at multiple angles on x, y and xz and yz axis. Various angles are represented by 125 of FIG. 31. The noted struts 124 are not meant to be representative of every thickness or iteration. What they do represent is the next potential steps in reducing barrel 100 harmonics and increasing cooling by applying a structure to the central bore area of a gun barrel 100.

Figure 33:
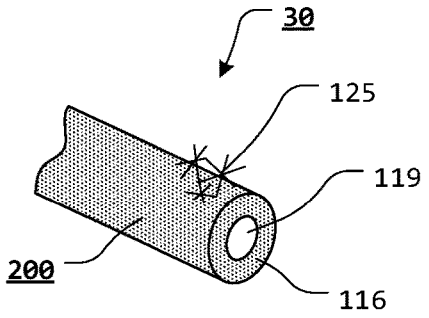
FIG. 33 illustrates a front, perspective view of a portion of an exemplary embodiment of a barrel, according to the presently disclosed systems, methods, and/or apparatuses.

As illustrated in FIG. 31, the elongate recesses 120 may optionally be hollow recesses, bounded or at least partially bounded by portions of the struts 124. Alternatively, as illustrated in FIG. 33, the elongate recesses 120 are not included and the one or more structural struts 124 are formed in or through portions of the barrel 100.

The struts 124 may comprise a material different from the materials used to form the remaining portions of the barrel 100. Because the struts 124 are formed integral to the barrel 100, the barrel 100 may optionally be formed by 3D type printing or other surface building technologies, which allow various structures of alternative materials to be formed within other materials and allow shapes of infinite style and variety. The potential shapes that could be employed within the barrel 100 or in an outer area beyond the projectile bore 119 are not all described herein, but will be understood and can be determined by a person skill in such art or by automated engineering systems driven by artificial intelligence cores.

In various exemplary embodiments, the elongate recesses 120 may optionally be parallel to the longitudinal axis of the projectile bore 119 spaced at substantially equal distance between adjacent elongate recesses 120 and the outer edge of the projectile chamber. The elongate recesses 120 may facilitate overall weight reduction by the removal of material from the barrel 100. Additionally, the elongate recesses 120 may allow for the largest total possible diameter of the barrel 100, which is made feasible due to the weight reduction directly attributed to the hollow elongate recesses 120. Stated another way, the hollow elongate recesses 120 may assist in increasing the torsional and sinusoidal stiffness of the barrel 100 because a larger total diameter is possible when compared to a substantially solid barrel 100 or rod like structure of the same mass. The larger total barrel 100 diameter and the additional elongate recesses 120 may increase the strength and stiffness of the barrel 100. Additionally, the elongate recesses 120 may create surfaces that will oppose each other as they are stressed flexurally, tensionally, and/or sinusoidally, and while in compression thereby equalizing resultant forces from a fired projectile.

According to certain exemplary embodiments, the elongate recesses 120 may enhance the cooling capabilities of the barrel 100 due to the increased surface area. The barrel 100 cooling capabilities may be further enhanced by facilitating the ventilation of outside cool air in concert with evacuating the heated air within the barrel 100. The evacuation of air within the elongate recesses 120 may be accomplished by a Venturi effect in which a fired projectile may pull outside cool air into the elongate recesses 120 as the projectile exits the barrel 100. Exterior surface finishes and textures that may increase the surface area of the gun barrel 100 stiffener apparatus and cooling system may accomplish further cooling.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A structured barrel, comprising:

a monolithic body comprising an elongate structure extending from a breach end to a muzzle end;

a projectile bore extending along a longitudinal axis from a projectile chamber to said muzzle end;

one or more elongate recesses formed in said body, wherein each of said elongate recesses comprises an elongate hole formed so as to extend within said body, from an open end defined proximate said muzzle end, and wherein each of said elongate recesses is formed such that a longitudinal axis of each elongate recesses is parallel or substantially parallel to said longitudinal axis of said projectile bore; and a sleeve positioned around at least a portion of said barrel to encompass at least a portion of said barrel and at least a portion of said one or more elongate recesses.

2. The structured barrel of claim 1, wherein said projectile bore comprises a single projectile bore.

3. The structured barrel of claim 1, wherein said breach end comprises external threads.

4. The structured barrel of claim 1, wherein at least a portion of said muzzle end comprises external threads.

5. The structured barrel of claim 1, wherein eight of said elongate recesses are formed in a radial fashion, at spaced apart locations, around said projectile bore.

6. The structured barrel of claim 1, wherein each of said one or more elongate recesses are substantially tubular or cylindrical, with a substantially circular, rectangular, square, or triangular cross-sectional profile.

7. The structured barrel of claim 1, wherein said one or more elongate recesses are arranged in a radial pattern, at spaced apart locations, around said projectile bore.

8. The structured barrel of claim 1, wherein said elongate recesses are arranged at a consistent distance from said projectile bore.

9. The structured barrel of claim 1, wherein said elongate recesses are arranged at various or alternating distances from said projectile bore.

10. The structured barrel of claim 1, wherein six or more of said elongate recesses are formed in a radial fashion, at spaced apart locations, around said projectile bore.

11. The structured barrel of claim 1, wherein a plurality of apertures are formed through said body of said barrel, wherein at least two of said plurality of apertures provide fluid communication between an exterior of said barrel and at least one of said one or more elongate recesses.

12. The structured barrel of claim 1, wherein one or more apertures are arranged in a substantially spiral arrangement along at least a portion of said barrel.

13. The structured barrel of claim 1, wherein each of said one or more elongate recesses extends from said open end, along one or more side walls, to a bottom wall.

14. The structured barrel of claim 13, wherein at least a portion of said side walls of each of said one or more elongate recesses includes at least some internal threads, stippling, surface preparation, coating, or texturing.

15. The structured barrel of claim 1, wherein a plurality of raised ridges, a plurality of recessed grooves, stippling, knurling, an exterior surface finish, coating, and/or texture element is provided on at least a portion of an exterior surface of said barrel.

16. A structured barrel, comprising:

a monolithic body comprising an elongate structure extending from a breach end to a muzzle end;

a projectile bore extending from a projectile chamber to said muzzle end;

one or more elongate recesses formed in said body, wherein each of said elongate recesses is formed so as to extend within said body, from an open end defined proximate said muzzle end, and wherein each of said elongate recesses is formed such that a longitudinal axis of each elongate recesses is parallel or substantially parallel to a longitudinal axis of said projectile bore; and a sleeve material positioned around at least a portion of said barrel to encompass at least a portion of said barrel, wherein said sleeve material includes filler particles embedded or dispersed within said sleeve material.

17. The structured barrel of claim 16, wherein said sleeve material is applied to at least a portion of an exterior surface of said barrel.

18. The structured barrel of claim 16, wherein at least some of said filler particles extend from an outer surface of said sleeve material.

19. The structured barrel of claim 16, wherein at least some of said filler particles are removed from said sleeve material to form voids in an outer surface of said sleeve material.

20. A structured barrel, comprising:

a monolithic body comprising an elongate structure extending from a breach end to a muzzle end;

a projectile bore extending from a projectile chamber to said muzzle end;

one or more elongate recesses formed in said body, wherein each of said elongate recesses is formed so as to extend within said body, from an open end defined proximate said muzzle end, and wherein each of said elongate recesses is formed such that a longitudinal axis of each elongate recesses is parallel or substantially parallel to a longitudinal axis of said projectile bore; and a sleeve material applied around at least a portion of said barrel to encompass at least a portion of said barrel, wherein said sleeve material includes a plurality of filler particles embedded or dispersed within said sleeve material, and wherein at least some of said filler particles extend from an outer surface of said sleeve material.

* * * * *